US009499360B2

(12) United States Patent
Kitano

(10) Patent No.: US 9,499,360 B2
(45) Date of Patent: Nov. 22, 2016

(54) ROLLER UNIT AND IMAGE FORMING APPARATUS

(71) Applicant: Oki Data Corporation, Tokyo (JP)

(72) Inventor: Isao Kitano, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/836,386

(22) Filed: Aug. 26, 2015

(65) Prior Publication Data

US 2016/0187831 A1 Jun. 30, 2016

(30) Foreign Application Priority Data

Dec. 26, 2014 (JP) ..... 2014-265615

(51) Int. Cl.
*B65H 3/06* (2006.01)
*B65H 7/02* (2006.01)
*B65H 7/20* (2006.01)

(52) U.S. Cl.
CPC ..... *B65H 3/0684* (2013.01); *B65H 3/0669* (2013.01); *B65H 7/02* (2013.01); *B65H 7/20* (2013.01)

(58) Field of Classification Search
CPC .... B65H 3/06; B65H 3/0669; B65H 3/0684; B65H 7/02; B65H 7/20
See application file for complete search history.

(56) References Cited

U.S. PATENT DOCUMENTS 7,594,647 B2 * 9/2009 DeVore ..... B65H 3/06 271/10.09
2003/0132566 A1 * 7/2003 Tsuei ..... B65H 3/0669 271/3.14
2004/0070136 A1 * 4/2004 Chung ..... B65H 3/06 271/117
2005/0104273 A1 * 5/2005 Kim ..... B65H 3/0684 271/10.01
2005/0263955 A1 * 12/2005 Kim ..... B65H 3/0684 271/121
2011/0121509 A1 * 5/2011 Shin ..... B65H 3/0669 271/117
2012/0074636 A1 * 3/2012 Choi ..... B65H 1/04 271/3.18
2013/0082438 A1 * 4/2013 Morimoto ..... H04N 1/00543 271/117
2015/0091244 A1 * 4/2015 Maehara ..... B65H 3/0684 271/117
2015/0321862 A1 * 11/2015 Song ..... B65H 3/0684 271/117

FOREIGN PATENT DOCUMENTS

JP 2009-274826 A 11/2009

* cited by examiner

*Primary Examiner* — Prasad Gokhale
(74) *Attorney, Agent, or Firm* — Panitch Schwarze Belisario & Nadel LLP

(57) ABSTRACT

A roller unit for reducing collision noise includes: a roller having a rotation shaft extending in a first direction; a facing member disposed as to face the roller via a recording medium; a holding member holding the roller movable between a separating position and a contacting position; an urging member applying first urging force to the roller in a second direction as to make the roller separated from the facing member; and a drive force applying member applying second urging force urging the roller in a third direction opposition to the second direction and rotational force rotating the roller in rendering the rotation shaft as a rotary center. The second urging force is provided to the roller via the holding member when the roller moves from the separating position to the contacting position as well as moves from the contacting position to the separating position.

12 Claims, 6 Drawing Sheets

ROLLER UNIT AND IMAGE FORMING APPARATUS

CROSS REFERENCE TO RELATED APPLICATION

This application claims priority benefits under 35 USC, section 119 on the basis of Japanese Patent Application No. 2014-265615, the disclosure of which is incorporated herein by reference.

BACKGROUND OF THE INVENTION

1. Field of the Invention

This invention relates to an image forming apparatus forming images using en electrophotographic method and a roller unit mounted thereto.

2. Description of Related Art

Medium supply apparatuses for supplying printing media contained in an accumulated manner in a feeding tray sheet by sheet to an image forming section have been used in, e.g., an image forming apparatus forming images on the printing media using an electrophotographic method (see, e.g., Japanese Application Publication (A1) No. 2009-274826).

SUMMARY OF THE INVENTION

A feeding tray loading printing media and a feeding roller for feeding printing media in a prescribed direction are mounted on such a medium apply apparatus. The feeding tray and the feeding roller are structured as to be movable relatively, and for example, while performing the feeding operation, the feeding roller and the printing medium are placed adjacently and contacting to each other, and while not performing the feeding operation, the feeding roller and the printing medium are separated from each other. However, operation noise such as, e.g., collision noise may occur while the feeding tray and the feeding roller come close to each other or separate from each other.

This disclosure is made to solve the above problems. It is therefore an object to provide a roller unit reducing operation noise and an image forming apparatus having the roller unit.

A roller unit according to an aspect of the invention includes the following elements: (a1) a roller having a rotation shaft extending in a first direction; (a2) a facing member disposed as to face the roller via a recording medium; (a3) a holding member holding the roller movable between a separating position at which the roller is separated from the facing member and a contacting position at which the roller contacts the recording medium on the facing member; (a4) an urging member applying first urging force to the roller in a second direction as to make the roller separated from the facing member; and (a5) a drive force applying member applying second urging force urging the roller in a third direction opposition to the second direction and rotational force rotating the roller in rendering the rotation shaft as a rotary center. The second urging force is provided to the roller via the holding member at a time when the roller moves from the separating position to the contacting position as well as at a time when the roller moves from the contacting position to the separating position.

An image forming apparatus according to another aspect of the invention includes the roller unit and an image forming unit.

According to yet another aspect of the invention, a roller unit includes: (b1) a roller having a rotation shaft extending in a first direction; (b2) a facing member disposed as to face the roller via a recording medium; (b3) a holding member holding the roller movable between a separating position at which the roller is separated from the facing member and a contacting position at which the roller contacts the recording medium on the facing member; (b4) an urging member applying first urging force to the roller in a second direction as to make the roller separated from the facing member; and (b5) a drive force applying member applying second urging force urging the roller in a third direction opposition to the second direction and rotational force rotating the roller in rendering the rotation shaft as a rotary center; and (b6) a control unit controlling move speed of the roller when the roller moves from the contacting position to the separating position.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF EMBODIMENTS

Hereinafter, embodiments according to the invention are described in detail with reference to the drawings. It is to be noted that the following description shows embodiments of the invention, and this invention is not limited to the embodiments described below. This invention is not limited to those of arrangements, layouts, sizes, size ratios, etc. shown in the respective drawings. The description will be made in the following sequence. First, the first embodiment is described in which an image forming apparatus is illustrated as having a feeding unit serving as a roller unit transmitting drive force intermittently to a roller when moving the roller from a contacting portion to a separating portion. Second, modifications of the first embodiment are described. A first modified example is shown as a structure transmitting drive force to the roller in multiple times when moving the roller from the roller from the contacting portion to the separating portion. A second modified example is shown as a structure transmitting drive force to the roller successively when moving the roller from the roller from the contacting portion to the separating portion. Third, the second embodiment is described in which an image forming apparatus is illustrated as having a fixing unit serving as a roller unit. Fourth, experiments are described. Fifth, other modifications are described.

First Embodiment

Figure 1:
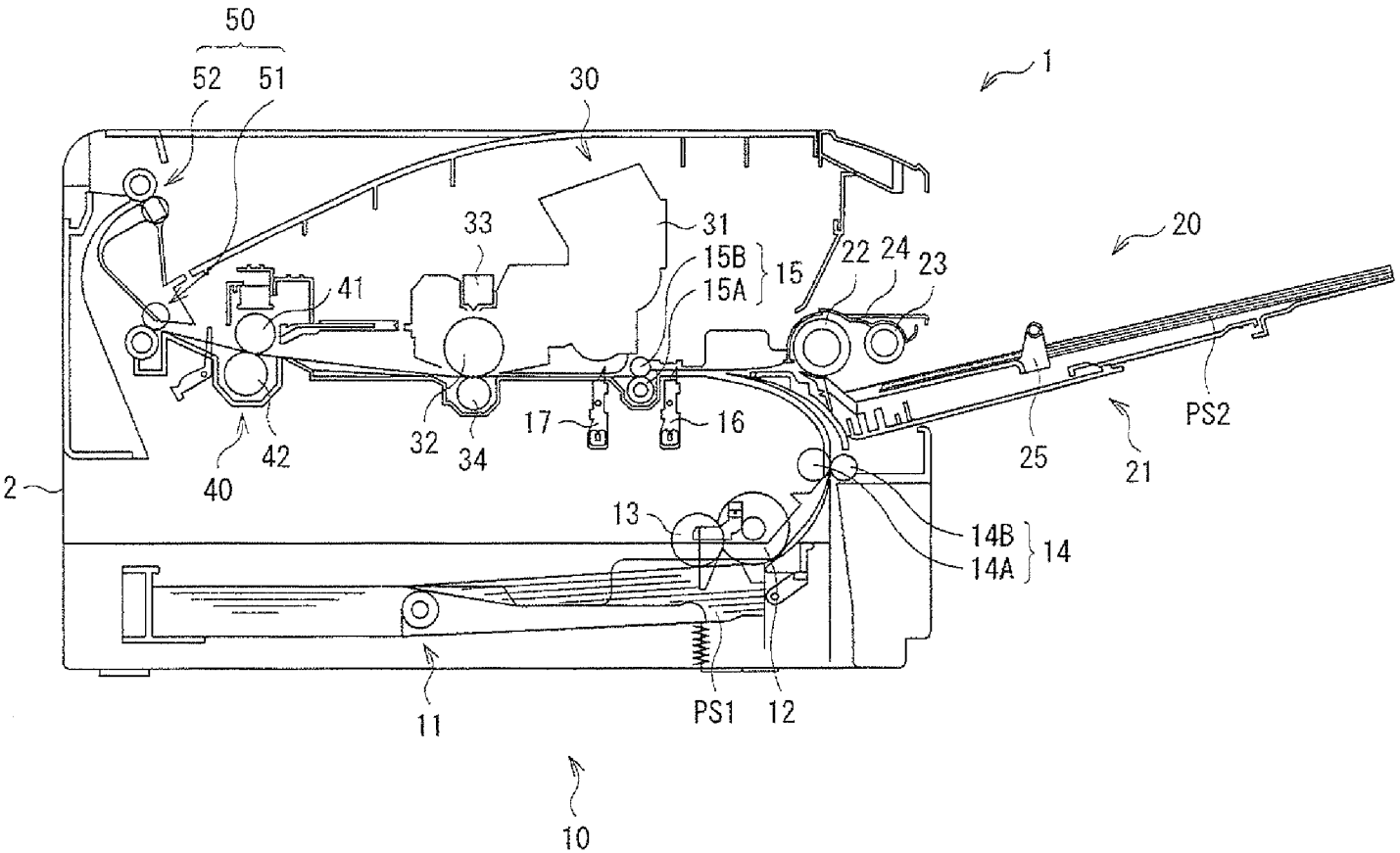
FIG. 1 is a schematic view showing an entire structure example of an image forming apparatus according to a first embodiment of the invention.

FIG. 1 is a schematic view showing an entire structure example of an image forming apparatus according to a first embodiment of the invention. The image forming apparatus 1 is a printer of an electrophotographic method forming images (e.g., monochrome images) to recording media PS1, PS2 (or namely, printing media or transfer materials) such as, e.g., paper. The image forming apparatus 1 includes, inside a housing 2, such as, e.g., a feeding unit 10 for feeding the recording media PS1 downstream, a feeding unit 20 for feeding the recording media PS2 downstream, an image forming unit 30 transferring images onto the recording media PS1, PS2, and a fixing unit 40 for fixing images transmitted to the recording media PS1, PS2. A delivery unit 50 including such as delivery roller pair 51, 52 for delivering to the exterior the recording media PS1, PS2 to which images are fixed, is arranged on a downstream side of the fixing unit 40. It is to be noted that in this specification the direction that the recording media PS1, PS2 proceed, is referred to as a conveyance direction, and a direction perpendicular to the conveyance direction (direction perpendicular to the surface of FIGS. 1, 2A, and 2B) is referred to as a lateral direction Y1. In this specification, a position near to the feeding unit 10 with a view from an arbitrary position is referred to as an upstream in regarding the conveyance direction, whereas a position remote from the feeding unit 10 is referred to as a downstream. The feeding unit 20 corresponds to one specific example of the roller unit of the invention; the image forming unit 30 corresponds to one specific example of the image forming unit of the invention; the lateral direction Y1 corresponds to one specific example of the first direction of the invention.

The feeding unit 10 includes a feeding tray 11, a feeding roller 12, a pickup roller 13, a conveyance roller pair 14 formed of an intermediate conveyance roller 14A and a pinch roller 14B, a conveyance roller pair 15 formed of a register roller 15A and a pressure roller 15B, an entry sensor 16, and a writing sensor 17.

The feeding tray 11 is a member containing the recording media PS1 in an accumulating state, and is detachably attached to a lower portion of the image forming apparatus 1.

The feeding roller 12 and the pickup roller 13 form a first feeding mechanism sequentially taking out the recording media PS1 upon separating sheet by sheet the recording medium PS1 located at a topmost position among the plural recording media PS1 accumulated on the feeding tray 11 and feeding the recording medium PS1 toward the conveyance roller pair 14.

The feeding unit 20 includes a feeding tray 21, a feeding roller 22, and a pickup roller 23.

The feeding tray 21 is a member containing the recording media PS2 in an accumulating state, and is provided on a side of the image forming apparatus 1.

The feeding roller 22 and the pickup roller 23 constitute a second feeding mechanism sequentially taking out the recording media PS2 upon separating sheet by sheet the recording medium PS1 located at a topmost position among the plural recording media PS2 accumulated on the feeding tray 21 and feeding the recording medium PS2 toward the conveyance roller pair 15. It is to be noted that the pickup roller 23 corresponds to one specific example of "roller" of the invention. The feeding tray 21 corresponds to one specific example of a facing member of the invention. Details of the feeding unit 20 will be described below.

The intermediate conveyance roller 14A and the pinch roller 14B are members as a pair sandwiching the recording medium PS1 fed from the feeding roller 12 and the feeding sub-roller or pickup roller 13 and conveying the recording medium PS1 on a downstream side. The register roller 15A and the pressure roller 15B are members as a pair sandwiching the recording medium PS1 and the recording medium PS2 fed from the conveyance roller pair 14 and the feeding unit 20 and conveying the media on the downstream side as correcting skews on the recording media PS1, PS2.

The entry sensor 16 is disposed on an upstream side of the register roller 15A and the pressure roller 15B, and detects the position of the recording media PS1, PS2. The writing sensor 17 arranged on the downstream side of the register roller 15A and the pressure roller 15B detects the position of the recording medium PS1 or the recording medium PS2 when instructing, to the image forming unit 30, a timing forming images onto the recording media PS1, PS2.

The image forming unit 30 forms, e.g., black color images (toner images) onto the recording media PS1, PS2 using black toner (developer). It is to be noted that the color of the toner and toner images is not limited to black color, and any color can be used. Multicolor images (toner images) may be formed on the recording media PS1, PS2 using multicolor toners (developers).

Those toners are structured including, e.g., prescribed colorant, parting agent, charge controlling agent, and processing agent, and are manufactured from mixing those components properly and being subject to surface treatments. The colorant, parting agent, and charge controlling agent, among those agents, function as internal additives, respectively. As external additives, such as silica and titanium oxide may be used, and as binder resin, such as polyester resin may be used. As colorant, dyes and pigments may be used solely or in plural kinds together.

As shown in FIG. 1, the image forming unit 30 has a toner cartridge (developer container) 31, an image drum (namely, photosensitive drum or image carrier) 32, an exposure head 33, and a transfer roller 34.

The toner cartridge 31 is a container containing toner in a prescribed color. That is, in this image forming unit 30, black toner is contained in the toner cartridge 31.

The image drum 32 is a member carrying electrostatic latent images on a surface thereof (surface layer portion), and is structured of a photosensitive body such as, e.g., organic photosensitive body. More specifically, the image drum 32 includes a conductive supporter and a photoconductive layer covering an outer periphery or surface of the conductive supporter. The conductive supporter is formed of a metal pipe made of such as, e.g., aluminum. The photo conductive layer has a structure accumulating, such as, e.g., a charge generation layer and a charge transfer layer in this order. It is to be noted that the image drum 32 thus formed rotates at a prescribed circumferential rate and receives e.g., black toner from the toner cartridge 31. Accordingly, black images (toner images), in which the black toner is attached to electrostatic latent images, are formed on the image drum 32.

The exposure head 33 is a device forming electrostatic latent images on a surface (surface layer portion) of the image drum 32 by radiating emission light to the surface of the image drum 32 to expose the surface of the image drum 32. The exposure head 33 is structured including, e.g., plural light sources generating emission light, and a lens array imaging the emission light on the surface of the image drum 32. As those light sources, exemplified are, such as, e.g., light emitting diodes (LEDs), and laser elements.

The transfer roller 34 is disposed facing the image drum 32, and is structured of a foamed semiconductive elastic rubber material. The transfer roller 34 sandwiches the recording media PS1, PS2 with the image drum 32, and is a member electrostatically transferring, e.g., black images formed on the image drum 32 onto the recording media PS1, PS2.

The fixing unit 40 is a member applying heat and pressure to the toner images on the recording media PS1, PS2 conveyed from the transfer roller 34 to fix the images on the media. The fixing unit 40 is structured including a heat roller 41 and a pressure roller 42 arranged in facing each other as to sandwich the recording media PS1, PS2.

The heat roller 41 includes a heater, not shown, such as a halogen lamp, inside, and is a member applying heat to the toner images on the recording media PS1, PS2.

The pressure roller 42 is disposed as to form a pressure unit at an interval to the heat roller 41, and is a member applying pressure to the toner images on the recording media PS1, PS2.

Figure 2A:
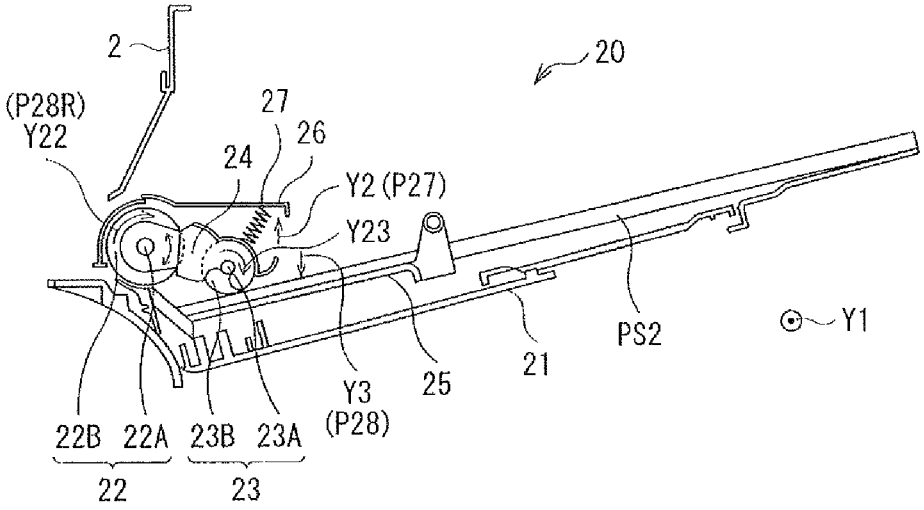
FIGS. 2A, 2B are side views showing, in a magnifying manner, an essential portion of the image forming apparatus shown in FIG. 1.
Figure 2B:
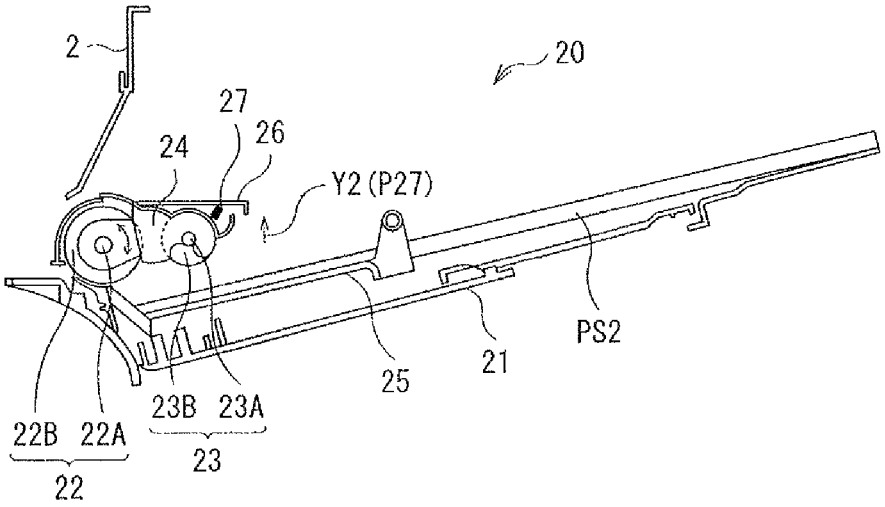
Figure 3:
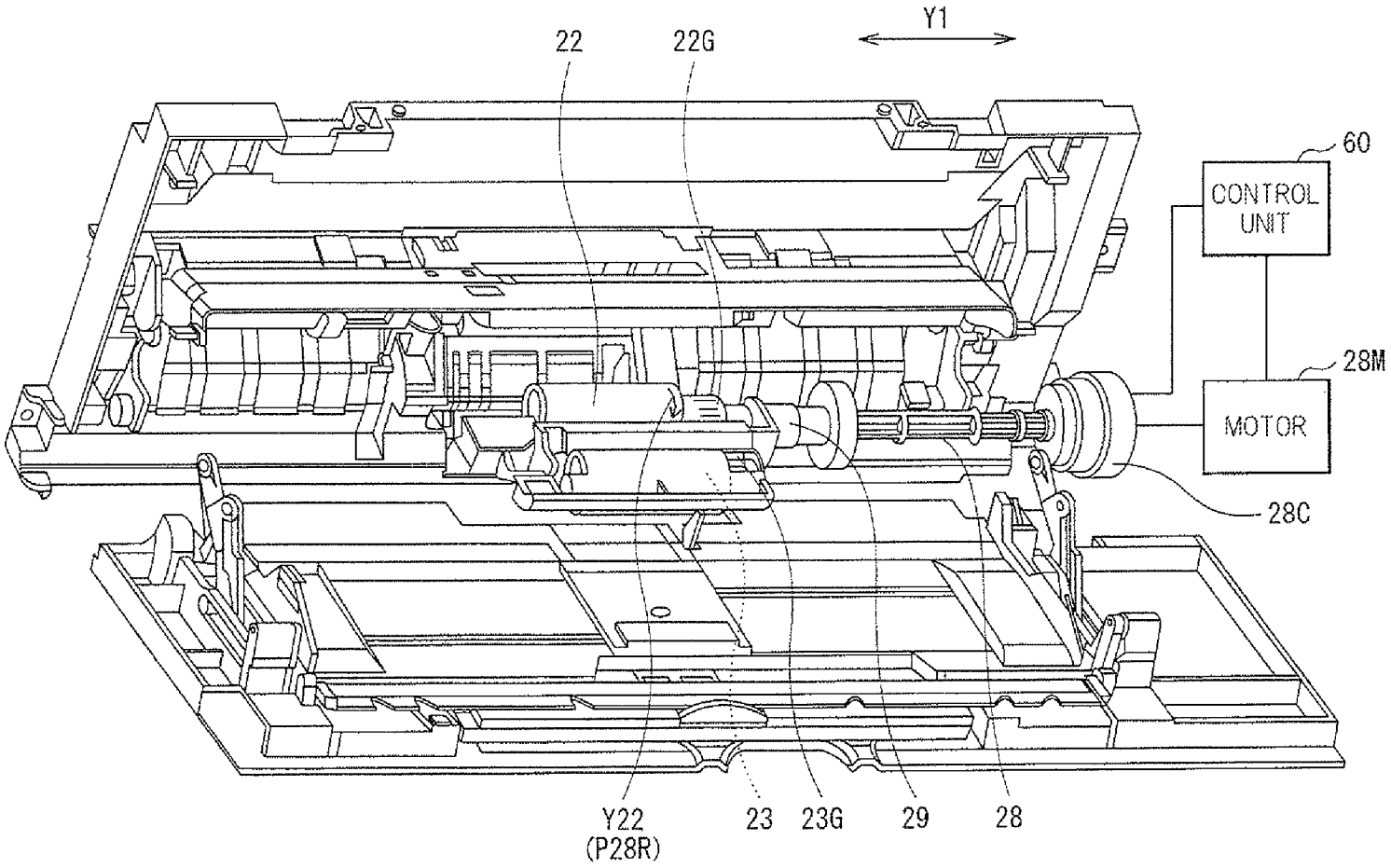
FIG. 3 is an exploded perspective view showing the essential portion of the image forming apparatus shown in FIG. 1.

Referring to FIGS. 2A, 2B, and FIG. 3, a detailed structure of the feeding unit 20 is described. FIGS. 2A, 2B are side views enlargedly showing the feeding unit 20 attached to a side wall portion of the housing 2 of the image forming apparatus 1. FIG. 2A shows a feeding state that the pickup roller 23 contacts the recording medium PS2 located at the topmost position among the plural recording media PS2 contained in the feeding tray 21. The position of the pickup roller 23 shown in FIG. 2A is referred to as a feeding position. To the contrary, FIG. 2B shows a waiting state that the pickup roller 23 is separated from the recording medium PS2 contained in the feeding tray 21. The position of the pickup roller 23 shown in FIG. 2B is referred to as a waiting position. The feeding position corresponds to one specific example of the contacting portion of the invention, whereas the waiting position corresponds to one specific example of the separating position of the invention. FIG. 3 is an exploded perspective view showing a vicinity of the feeding unit 20 of the image forming apparatus 1.

The feeding unit 20 includes, in addition to the feeding tray 21, the feeding roller, and the pickup roller 23, a bracket 24, a sheet plate 25, a stopper 26, a spring 27, a feeding shaft 28, and a torque limiter 29.

The pickup roller 23 is formed in a substantially cylindrical shape with or without a hollow and includes a shaft 23A extending in the lateral direction Y1 and an elastic layer 23B continuously covering the circumference of the shaft 23A in the rotational direction. A gear 23G is formed at one end of the shaft 23A in indirectly meshing a gear 22G, as described below, of the feeding roller 22. The elastic layer 23B is made of an elastic material such as, e.g., a synthetic resin, and the outer periphery of the layer 23B contacts the recording medium PS2. The pickup roller 23 is supported with the bracket 24 at each end in a rotatable manner in a direction of Arrow Y23 around the shaft 23A as a center. The pickup roller 23 rotates around the shaft 23A as the center upon transmission of drive force from a motor 28M as described below via the gear 22G to the gear 23G. According to the rotation of the pickup roller 23, the recording medium PS2 is picked up sheet by sheet, and the picked up recording medium PS2 is transferred to the feeding roller 22.

The feeding roller 22 is a member feeding the recording medium PS2 of the single sheet picked up according to the rotation of the pickup roller 23 toward the downstream side in a direction of Arrow Y22. The feeding roller 22 includes a shaft 22A in a cylindrical shape with or without a hollow, and an elastic layer 22B continuously covering the circumference of the shaft 22A in the rotational direction. The shaft 22A is made of, e.g., a resin, and the elastic layer 22B is made of an elastic material such as a synthetic rubber.

As shown in FIG. 3, a feeding shaft 28 is secured to one end of the feeding roller 22 via the gear 22G. The feeding shaft 28 is a metal made member in a pipe or pillar shape extending in the lateral direction Y1. The motor 28M as a drive source is connected indirectly to the other end of the feeding shaft 28 via a clutch 28C. The feeding roller 22 therefore rotates in a direction of Arrow Y22 together with the feeding shaft 28 and the gear 22G according to the drive force transmitted from the motor 28M via the clutch 28C. Where the clutch 28C is turned off, the drive force from the motor 28M is not transmitted to the feeding shaft 28 and the gear 22G, thereby stopping the rotation of the feeding shaft 28 and the gear 22. The feeding shaft 28 is one specific example corresponding to the drive force applying member of the invention. The motor 28M and the clutch 28C are made operable according to commands from a control unit 60.

The bracket 24 is a member functioning as an arm lifting up and down the pickup roller 23 between the waiting position and the feeding position. The pickup roller 23 is rotationally supported at one end of the bracket 24 around the shaft 23A as a rotation center. The shaft 22A is rotationally supported at the other end of the bracket 24. The bracket 24 is a member pivotally movable around the shaft 22A as a center in association with the shaft 22A rotated by the drive force from the motor 28M. The bracket 24 is coupled to the shaft 22A via the torque limiter 29 (see FIG. 3). The torque limiter 29 is a device cutting off torque transmission by cutting off the connection when subjecting to an overload. As such the torque limiter 29, employed are a mechanical type utilizing friction and resistance, and a magnetic type using a magnet or magnets. From existence of the torque limiter 29, force urging the pickup roller 23 toward the recording medium PS2 is maintained to be constant as not exceeding a setting value set with the torque limiter 29, even where the shaft 22A further rotates in the direction of Arrow Y22 after the pickup roller 23 contacts the recording medium PS2. Accordingly, any overloaded exertion to the recording medium PS2, the sheet plate 25, and the feeding tray 21, supporting the recording medium PS2 can be avoided. Rotational operation of the feeding roller 22 may not be affected from pivotal movement of the bracket 24. That is, the feeding roller 22 is structured to be rotatable regardless beginning and stop of the pivotal movement of the bracket 24. The bracket 24 corresponds to one specific example of the holding member of the invention.

The sheet plate 25 is arranged on a top of the feeding tray 21 and is a member supporting the recording medium PS2 from a lower side.

The stopper 26 is a member holding, at the waiting position, the bracket 24 holing the pickup roller 23, and is coupled to the bracket 24 via the spring 27. The spring 27 functions as an urging member providing urging force P27 in a direction of Arrow Y2, or namely a second direction, as to render the bracket 24 contact the stopper 26 secured to the housing 2, or in other words, as to render the pickup roller 23 and the recording medium PS2 separated from each other. As shown in FIG. 2B, during the waiting state, the bracket 24 and the stopper 26 come close to each other or contact closely with each other according to the urging force P27 of the spring 27. The urging force P27 corresponds to one specific example of the first urging force of the invention.

The feeding shaft 28 functions as a member providing, to the pickup roller 23, urging force P28 (see FIG. 2A) urging the pickup roller 23 in a direction of Arrow Y3, or namely a third direction, opposite to the direction of Arrow Y2, and rotational force P28R rotating the pickup roller 23 in a direction of Arrow Y23 around the shaft 23A as a rotation center. The urging force P28 is force urging the pickup roller 23 to the recording medium PS2. It is to be noted that each of the directions of Arrows Y2, Y3 is perpendicular to the first direction Y1. The urging force P28 corresponds to one specified example of the second urging force of the invention.

The urging force P28 from the feeding shaft 28 is given to the pickup roller 23 at any time when the pickup roller 23 moves from the waiting position, or namely the separating position to the feeding position, or namely the contacting position, when the pickup roller 23 is held at the feeding position to execute feeding operation, and when the pickup roller 23 moves from the feeding position to the waiting position. The feeding shaft 28 rotates the pickup roller 23 after the pickup roller 23 begins to move from the waiting position to the feeding position, or after the pickup roller 23 comes to contact the recording medium PS2. The urging force P28 from the feeding shaft 28 is provided in, e.g., a continuous way to the pickup roller 23 at a time when the pickup roller 23 moves from the waiting position to the feeding position or while executing the feeding operation. It is desirable that the strength of the urging force P28 is larger than the strength of the urging force P27 at that time. To the contrary, the urging force P28 is provided intermittently to the pickup roller 23 when the pickup roller 23 moves from the feeding position to the waiting position. At that time, the strength of the urging force P28 may be larger than the strength of the urging force P27 or may be equal to or less than the strength of the urging force P27. The strength of the urging force P28 may be changeable according to an adjustment of the output of the motor 28M done by, e.g., the control unit 60.

During the period from the beginning of the movement of the pickup roller 23 from the feeding position to the waiting position to the completion of the movement, a total time stopping the urging force P28 by the feeding shaft 28 applying to the pickup roller 23 may be longer than a total time applying the urging force P28 by the feeding shaft 28 to the pickup roller 23.

When the pickup roller 23 moves between the feeding position and the waiting position, the moving speed of the pickup roller 23 is controlled by the control unit 60. The control unit 60 controls entire operations and movements of the image forming apparatus 1.

With this image forming apparatus 1, the toner images are transferred to the recording media PS1, PS2, as following ways.

Specifically, where printing image data are entered from an external apparatus to the image forming apparatus 1, which is in an active state, a command/image processing unit, not shown, transmits printing commands to the control unit 60. The control unit 60 begins the printing operation of the printing image data according to the printing command.

When the printing operation begins, the recording media PS2 contained in the feeding tray 21 are picked up sheet by sheet with the pickup roller 23 and fed to the downstream side. The recording medium PS2 fed from the pickup roller 23 goes to the conveyance roller pair 15. The recording medium PS2 then is conveyed to the image forming unit 30 by way of the conveyance roller pair 15. Toner images are transferred onto the recording medium PS2 at the image forming unit 30 as follows.

At the image forming unit 30, black toner images are formed with the following electrophotographic process. First, a prescribed applied voltage is supplied to a charge roller, not shown, and charges the surface (surface layer portion) of the image drum 32 uniformly. Emission light is radiated form the exposure head 33 to the surface of the image drum 32 to make exposures, thereby forming electrostatic latent images corresponding to printing patterns on the image drum 32. Toner is attached to the electrostatic latent images on the image drum 32 from a developing roller, not shown. The toner (toner images) on the image drum 32 is transferred onto the recording medium PS2 by electric field formed between the drum and the transfer roller 34.

Then, the toner (toner images) on the recording medium PS2 is fixed in application of heat and pressure at the fixing unit 40. The recording media PS2 to which toner is fixed is delivered with the delivery roller pair 51, 52 to the exterior of the image forming apparatus 1.

Figure 4:
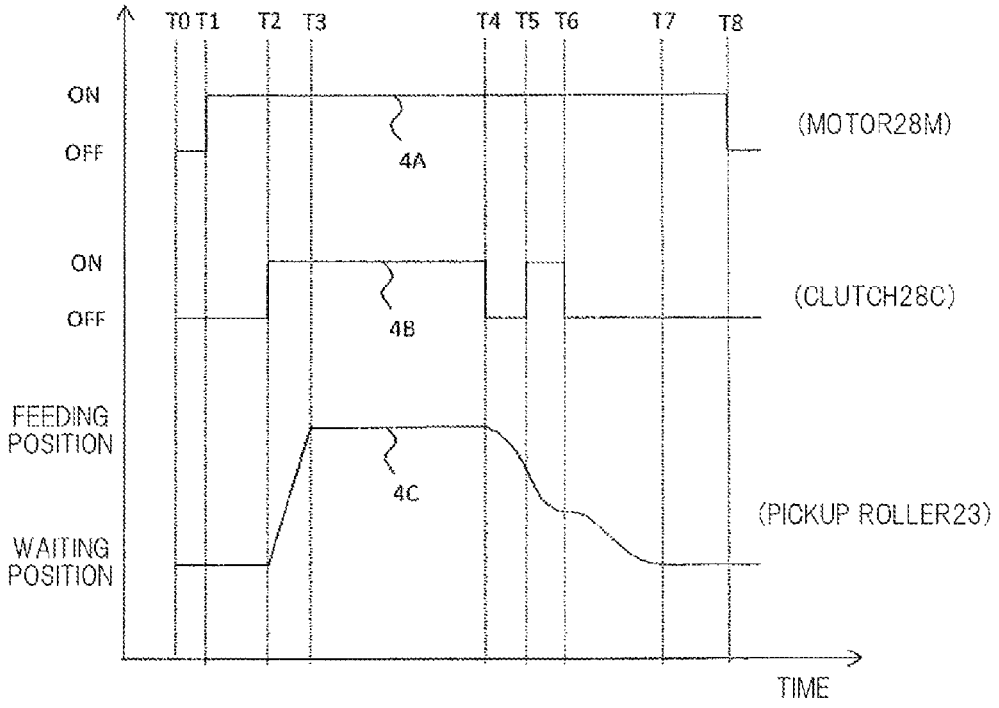
FIG. 4 is a timing chart showing feeding operation done at a feeding unit shown in FIG. 1.

Referring to FIG. 4, in addition to FIGS. 1 to 3, feeding operation of the recording medium PS2 done at the feeding unit 20 is described next. It is to be noted that the following operations are executed according to the instructions from the control unit 60. In FIG. 4 as a time chart, a line 4A indicates turning on and off of the motor 28M; a line 4B indicates turning on and off of the clutch 28; a line 4C indicates positional changes of the pickup roller 23 between the waiting position and the feeding position.

The control unit 60 transmits a command to the motor M28 at a time T0, thereby activating the motor M28 at a time T1 (see, line 4A in FIG. 4). At this stage, the pickup roller 23 is located at the waiting position shown in FIG. 2B (see, line 4C in FIG. 4). The clutch 28 is activated at a time T2 to be in a coupled state (see, line 4B in FIG. 4), thereby transmitting the drive force of the motor 28M to the feeding shaft 28, thereby rotating the feeding shaft 28. With this rotation, the feeding roller 22 and the pickup roller 23 begin to rotate in the direction of Arrow Y22 and in the direction of Arrow Y23, respectively. At the same time, the bracket 24 begins to move pivotally around the shaft 22A as a center, thereby moving the pickup roller 23 from the waiting position to the feeding position shown in FIG. 2A (see, line 4C in FIG. 4). Consequently, the rotating pickup roller 23 at a time T3 contacts the surface of the topmost recording medium PS2 supported on the sheet plate 25 and begins to feed the recording medium PS2 toward the feeding roller 22. The recording medium PS2 is sent out by the feeding roller 22 toward the conveyance roller pair 15. The operation from the time T3 to a time T4 is called as feeding execution operation for convenience.

When completing the feeding execution operation at the time T4, the clutch 28C is made to be cut off once (see, line 4B in FIG. 4), and the drive force transmission from the motor 28M to the feeding shaft 28 is cut off. Consequently, the feeding shaft 28 stops rotating, thereby stopping rotating of the feeding roller 22 and the pickup roller 23 at the same time, respectively. The urging force P28 from the feeding shaft 28 in the direction of Arrow Y3 is not provided to the bracket 24, and the bracket 24 begins to move pivotally as coming closer to the stopper 26 according to the urging force P27 of the spring 27 in the direction of Arrow Y2 (FIG. 2B). That is, the pickup roller 23 starts moving from the feeding position to the waiting position (see, line 4C in FIG. 4). Before the completion of the pickup roller 23 moving from the feeding position to the waiting position, or namely at a time T5 before the bracket 24 reaches the stopper 26, the clutch 28C is activated again to be in the coupled state (see, line 4B in FIG. 4). With this coupling, the drive force from the motor 28M is transmitted again to the feeding shaft 28, thereby providing the urging force P28 from the feeding shaft 28 to the bracket 24 again. As a result, the moving speed of the pickup roller 23 from the feeding position to the waiting position is lowered, so that the positional change of the pickup roller 23 shows a gentle slope. The clutch 28C is then turned to be cut off again at a time T6 (see, line 4B in FIG. 4), and the pickup roller 23 reaches the waiting position at a time T7 (see, line 4C in FIG. 4). After the pickup roller 23 reaches the waiting position, the motor 28M is stopped at a time T8.

In this embodiment, the urging force P28 from the feeding shaft 28 in the direction of Arrow Y3 is provided to the pickup roller 23 at times when the pickup roller 23 moves both of from the waiting position to the feeding position and from the feeding position to the waiting position, according to, e.g., control of the control unit 60 during the series of the feeding operations done by the feeding unit 20. Accordingly, the moving speed of the pickup roller 23 can be controlled freely. Noises occurring with the pivotal movements of the bracket 24 supporting the pickup roller 23 can be therefore reduced. For example, at a time completing the feeding operation, the collision noise that the bracket 24 contacts the stopper 26 in returning to the waiting position, can be reduced. This is because the pivotal movement speed of the bracket 24 can be reduced by effectuating the urging force P28 from the feeding shaft 28 in the opposite direction more than a situation where the bracket 24 is moved pivotally only by the urging force P27 from the spring 26, and because the bracket 24 can further gently contact to the stopper 26.

With this embodiment, specifically, when the pickup roller 23 moves from the feeding position to the waiting position, the urging force P28 is given intermittently to the pickup roller 23. Power consumption therefore may be reduced more than a situation that the feeding shaft 28 is rotated over the entire period of the movement. At the time of the completion of the feeding operation, the recording medium PS2 may not move out of the feeding tray 21 according to the moving operation of the pickup roller 23 from the feeding position to the waiting position, because the urging force P28 is given to the bracket 24 after the pickup roller 23 is separated from the recording medium PS2.

First Modified Example

Figure 5:
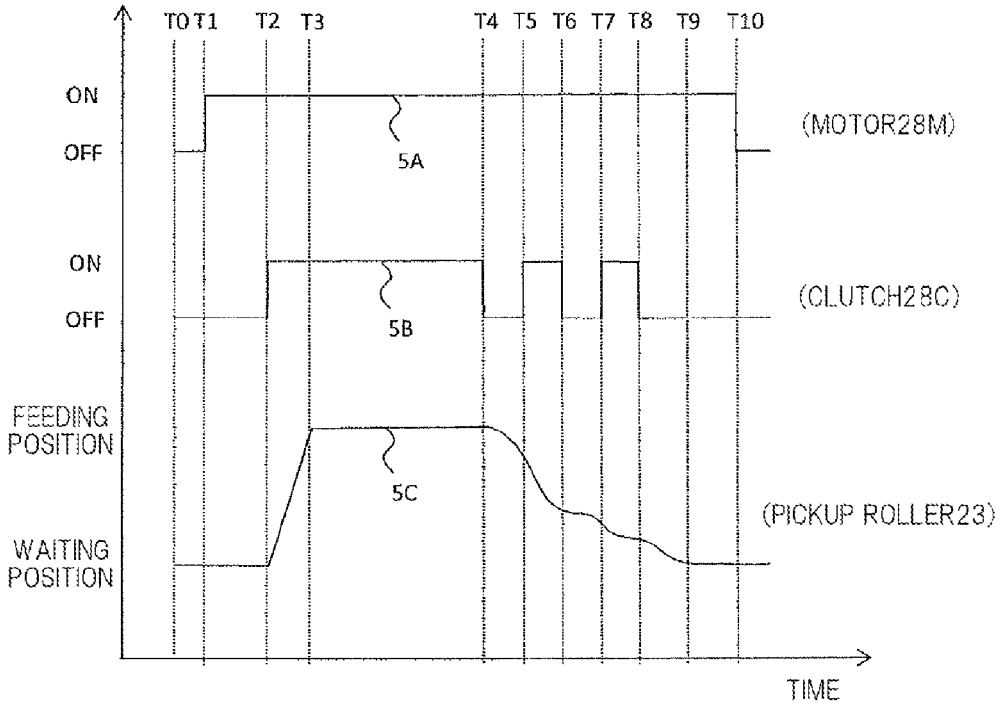
FIG. 5 is a timing chart showing feeding operation done at a feeding unit as a first modified example.

Referring to FIG. 5, a first modified example as modified from the above embodiment is described. The following operations are executed according to commands from the control unit 60. In FIG. 5 as a time chart, a line 5A indicates turning on and off of the motor 28M; a line 5B indicates turning on and off of the clutch 28; a line 5C indicates positional changes of the pickup roller 23 between the waiting position and the feeding position.

In the first embodiment, the urging force P28 is provided only once to the pickup roller 23 when the pickup roller 23 moves from the feeding position to the waiting position. To the contrary, in this modified example, the urging force P28 is given to the pickup roller 23 in plural time intermittently. More specifically, the clutch 28C is activated intermittently two times (see, line 5B in FIG. 5) from the time T5 to the time T6 and from the time T7 to the time T8 between the time T4 and the time T9 until that the pickup roller 23 completes moving to the waiting position after the clutch 28C is made cut off once upon completion of the feeding execution operation. With this operation, the moving speed of the pickup roller 23 moving from the feeding position to the waiting position is reduced twice, so that the positional change of the pickup roller 23 shows a gentle slope.

With this modified example, the pickup roller 23 can move further gently from the feeding position to the waiting position. Consequently, collision noise occurring when the bracket 24 returned to the waiting position contacts the stopper 26 may be reduced further.

Second Modified Example

Figure 6:
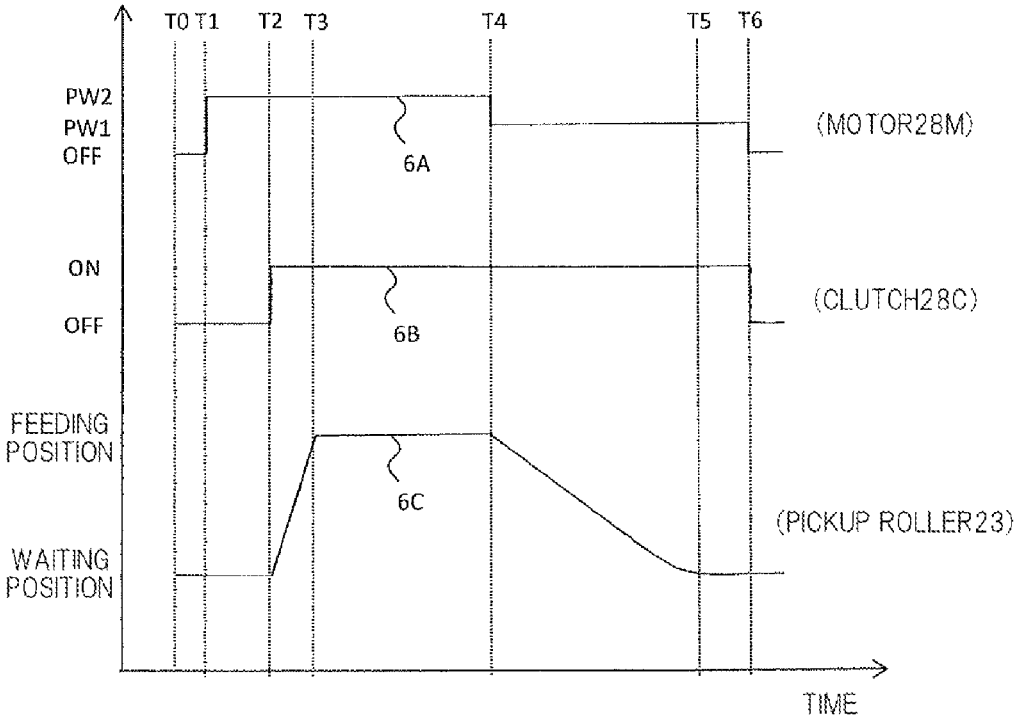
FIG. 6 is a timing chart showing feeding operation done at the feeding unit as a second modified example.

Referring to FIG. 6, a second modified example as modified from the above embodiment is described. In the above first embodiment, when the pickup roller 23 moves from the feeding position to the waiting position, the urging force P28 is given to the pickup roller 23 intermittently. To the contrary, with this modified example, the urging force P28 weaker than the urging force P27 is continuously provided when the pickup roller 23 moves from the feeding position to the waiting position.

More specifically, as shown by a line 6A in FIG. 6, the urging force P28 stronger than the urging force P27 is continuously given to the pickup roller 23 by producing larger output PW2 (>PW1) of the motor 28M from the time T1 when the motor 28M is activated to the time T4 of the completion of the feeding execution operation. After activation of the motor 28M, the clutch 28C is activated at the time T2 and enters into the coupling state (see, line 6B in FIG. 6), so that the drive force of the motor 28M is transmitted to the feeding shaft 28, thereby beginning the movement of the pickup roller 23. At the same time as the end of the feeding execution operation at the time T4 after the start of the feeding execution operation at the time T3, the motor 28M provides an output PW1 smaller than the output PW2, thereby continuously giving to the pickup roller 23 the urging force P28 weaker than urging force P27. With this operation, the pickup roller 23 can move gently from the feeding position to the waiting position at a constant speed, and the pickup roller 23 reaches the waiting position at the time T5 (see, line 6C in FIG. 6). The clutch 28C maintains continuously the coupled state from the time T2 to the time T5 (see, line 6B in FIG. 6). Then, the control unit 60 stops the clutch 28C and the motor 28M at the time T6.

With this modified example, the pickup roller 23 can move gently from the feeding position to the waiting position. As a result, collision noise occurring when the bracket 24 returned to the waiting position contacts the stopper 26 may be reduced further. It is to be noted that the pickup roller 23 moves from the feeding position to the waiting position at a constant speed, the speed may be changed properly.

Second Embodiment

Figure 7:
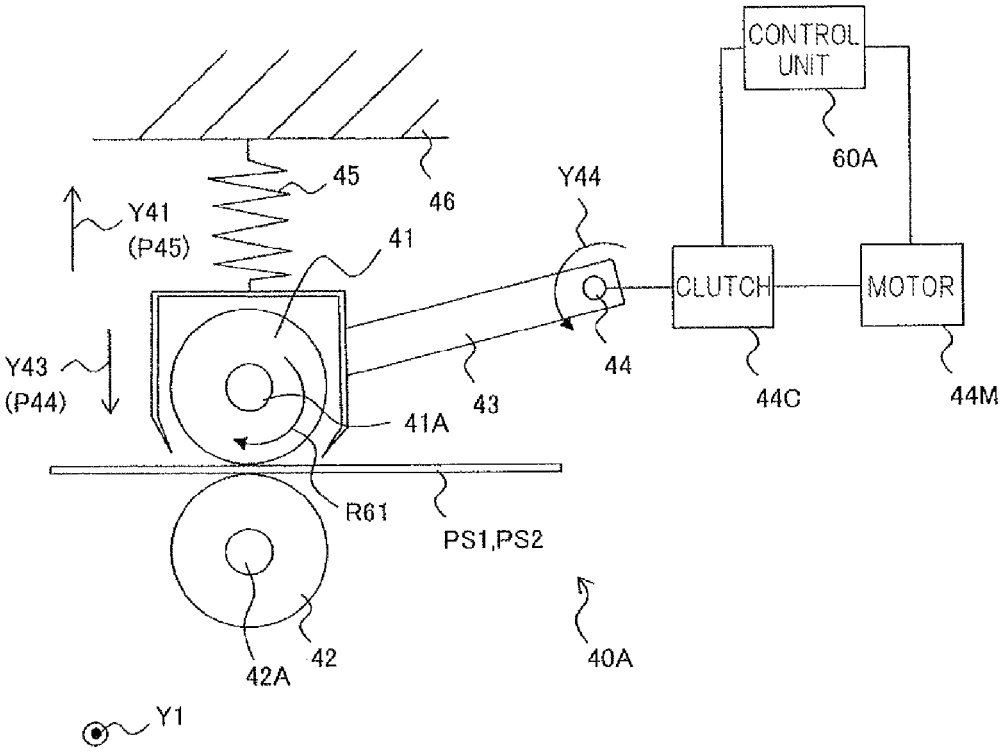
FIG. 7 is a schematic view showing an entire structure example of an image forming apparatus according to a second embodiment of the invention.

Referring to FIG. 7, an image forming apparatus according to a second embodiment of the invention is described. FIG. 7 is a schematic view showing a structure of the fixing unit 40A in the image forming apparatus. The fixing unit 40A corresponds to "the roller unit" of the invention. The same reference numbers are given to substantially the same structural elements as those in the fixing unit 40 in the first embodiment, and those explanations are omitted as appropriately.

The fixing unit 40A includes, in addition to the heat roller 41 and the pressure roller 42, a bracket 43, a shaft 44, a spring 45, a stopper 46, a clutch 44C, a motor 44M, and the control unit 60A. In this fixing unit 40A, the heat roller 41 and the pressure roller 42 sandwiches the recording media PS1, PS2 at a fixing portion when conducting fixing operation fixing toner images on the recording media PS1, PS2. After the completion of the fixing portion, the heat roller 41 moves to a waiting position contacting a housing 46 located above.

The bracket 43 is a member functioning as an arm lifting the heat roller 41 up and down between the waiting position and the fixing position. The heat roller 41 is supported in a rotatable manner around the shaft 41A as a rotation center at one end of the bracket 43. The shaft 44 is supported rotatably at the other end of the bracket 43. The bracket 43 is a member moving pivotally around the shaft 44 in association with the rotation of the shaft 44 according to the drive force from the motor 44M. It is to be noted that the bracket 43 corresponds to one specific example of the holding member of the invention. The heat roller 41 corresponds to one specific example of the roller of the invention, whereas the pressure roller 42 corresponds to one specific example of the facing member of the invention.

The spring 45 is an urging member for coupling the stopper 46 with the bracket 43 and for making those closer to each other.

The stopper 46 is a member holding, at the waiting position, the bracket 43 holing the heat roller 41, and is coupled to the bracket 43 via the spring 45. The spring 45 functions as an urging member providing urging force P45 in a direction of Arrow Y41, or namely a second direction, as to render the bracket 43 contact the stopper 46 secured to the housing 2, or in other words, as to render the heat roller 41 and the pressure roller 42 separated from each other. During the waiting state, the bracket 43 and the stopper 46 come close to each other or contact closely with each other according to the urging force P45 of the spring 45. The urging force P45 corresponds to one specific example of the first urging force of the invention.

The shaft 44 functions as a member providing, to the heat roller 41, urging force P44 urging the heat roller 41 in a direction of Arrow Y43, or namely a third direction, opposite to the direction of Arrow Y41, and rotational force rotating the heat roller 41 in a direction of Arrow Y41 around the shaft 44 as a rotation center. The urging force P44 described above is force urging the heat roller 41 to the pressure roller 42 via the sandwiched recording media PS1, PS2. The urging force P44 is produced by the bracket 43 moving pivotally in a direction of Arrow Y44 according to the rotation of the shaft 44. It is to be noted that each of the directions of Arrows Y41, Y43 is perpendicular to the first direction Y1. The urging force P44 corresponds to one specific example of the second urging force of the invention. The shaft 44 corresponds to one specific example of the drive force applying member of the invention.

The urging force P44 from the shaft 44 is given to the heat roller 41 at any time when the heat roller 41 moves from the waiting position, or namely the separating position to the fixing position, or namely the contacting position, when the heat roller 41 is held at the fixing position to execute fixing operation, and when the heat roller 41 moves from the fixing position to the waiting position. The urging force P44 from the shaft 44 is provided in, e.g., a continuous way to the heat roller 41 at a time when the heat roller 41 moves from the waiting position to the fixing position or while executing the fixing operation. It is desirable that the strength of the urging force P44 is larger than the strength of the urging force P45 at that time. To the contrary, the urging force P44 is provided intermittently to the heat roller 41 when the heat roller 41 moves from the fixing position to the waiting position. At that time, the strength of the urging force P44 may be larger than the strength of the urging force P45 or may be equal to or less than the strength of the urging force P45. The strength of the urging force P44 may be changeable according to an adjustment of the output of the motor 44M done by, e.g., the control unit 60A.

During the period from the beginning of the movement of the heat roller 41 from the fixing position to the waiting position to the completion of the movement, a total time stopping the urging force P44 by the shaft 44 applying to the heat roller 41 may be longer than a total time applying the urging force P44 by the shaft 44 to the heat roller 41.

When the heat roller 41 moves between the fixing position and the waiting position, the moving speed of the heat roller 41 is controlled by the control unit 60.

In this embodiment, the urging force P44 from the shaft 44 in the direction of Arrow Y44 is provided to the heat roller 41 at times when the heat roller 41 moves both of from the waiting position to the fixing position and from the fixing position to the waiting position, according to, e.g., control of the control unit 60A during the series of the fixing operations done by the fixing unit 40A. Accordingly, the moving speed of the heat roller 41 can be controlled freely. Noises occurring with the pivotal movements of the bracket 43 supporting the heat roller 41 can be therefore reduced. For example, at a time completing the fixing operation, the collision noise that the bracket 43 contacts the stopper 46 in returning to the waiting position, can be reduced. This is because the pivotal movement speed of the bracket 43 can be reduced by effectuating the urging force P44 from the shaft 44 in the opposite direction more than a situation where the bracket 43 is moved pivotally only by the urging force P45 from the spring 45, and because the bracket 43 can further gently contact to the stopper 46.

Experiments

Figure 8A:
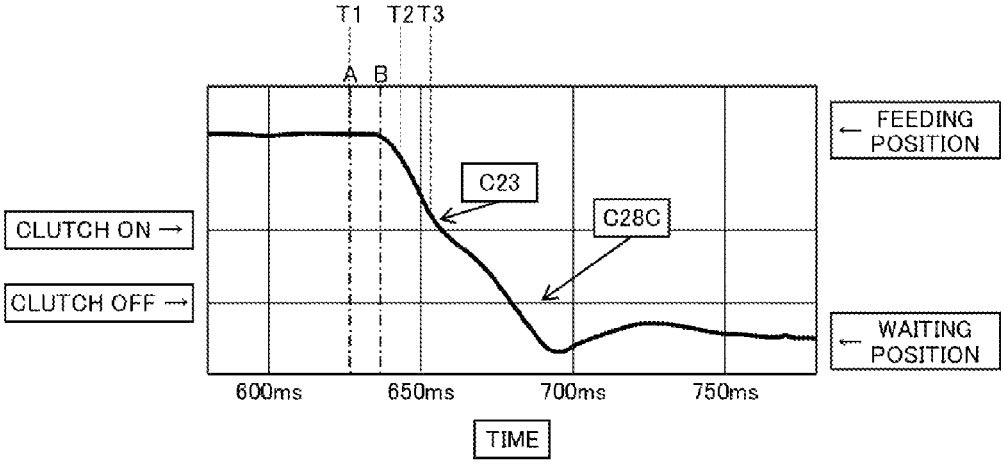
FIGS. 8A, 8B are graphs of waveforms showing operation timing of a clutch and portions of a pickup roller in Experiments No. 1, No. 2, respectively.
Figure 8B:
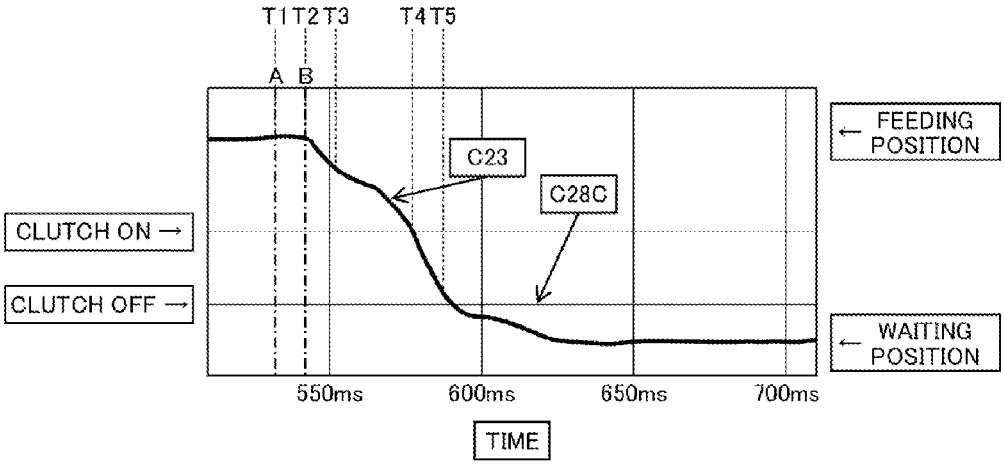

Referring to FIGS. 8A, 8B, examination results of operations where the image forming apparatus 1 according to the above first embodiment is produced, are shown. In FIGS. 8A, 8B as time charts, a line C23 indicates positional changes of the pickup roller 23 moving from the feeding position to the waiting position; a line C28C indicates turning on and off of the clutch 28C.

Experiment No. 1

First, when the pickup roller 23 moved from the feeding position to the waiting position, the urging force P28 was given to the pickup roller 23 only one time. The result is shown in FIG. 8A. In this experiment, after the clutch 28C was made cut off once at the time T1 to complete the feeding execution operation, the clutch 28C was again activated at the time T2 to be in the coupled state. The clutch 28C was again cut off at the time T3, thereby rendering the pickup roller 23 reach the waiting position.

Experiment No. 2

Subsequently, when the pickup roller 23 moved from the feeding position to the waiting position, the urging force P28 was given to the pickup roller 23 two times. The result is shown in FIG. 8B. In this experiment, after the clutch 28C was made cut off once at the time T1 to complete the feeding execution operation, the clutch 28C was again activated at the time T2 to be in the coupled state. The clutch 28C was cut off at the time T3, coupled at the time T4, and again cut off at the time T5 sequentially, thereby rendering the pickup roller 23 reach the waiting position as it was.

As apparent from the results shown in FIG. 8A, 8B, when the pickup roller 23 moved from the feeding position to the waiting position, the urging force P28 in the direction opposite to the urging force P27 was provided to the pickup roller 23, so that the positional change of the pickup roller 23 became gentle. That is, the moving speed of the pickup roller 23 can be made slower. Particularly, in the experiment No. 2, because the urging force P28 was provided to the pickup roller 23 two times intermittently, the positional change of the pickup roller 23 became further more gentle. According to these results, with the invention, it was confirmed that collision that the bracket 24 returning to the waiting position contacted the stopper 26 was made ease.

Other Modified Examples

As described above, although this invention is described using the embodiments and the modified examples, this invention is not limited to those embodiments and the like, and various modifications can be made. For example, although the image forming apparatuses are described as forming monochrome images in the above embodiments, this invention is not limited to those. The image forming apparatus may form multicolor images in transferring, e.g., four color toner images. In the above embodiments, the image forming apparatus 1 of the primary transfer method is described, but the invention is applicable to a secondary transfer method.

The steps of the feeding operation referring to FIG. 4 as described in the above embodiments are merely examples. This invention is not limited to those, and can be done with other steps.

The series of processings described in the above embodiments can be executed with hardware or circuits, as well as with software or programs. In a case done with the software, the software is structured with program groups executing with the computer respective functions. The respective programs may be used upon incorporated in the computer, and may be used upon installation to the computer from networks or recording media.

In the embodiments, the situations that the roller unit of the invention is applied to feeding unit and the fixing unit, are described, but this invention is not limited to those, and applicable to other portions or units.

In the above embodiments, exemplified as a specific example of the image forming apparatus of the invention is the image forming apparatus having the printing function, but this invention is not limited to this. That is, this invention is applicable to image forming apparatuses functioning as MPFs having such as, e.g., scanning function, and facsimile function, in addition to the printing function.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A roller unit comprising:

a roller having a rotation shaft extending in a first direction;

a facing member facing the roller via a recording medium;

a holding member holding the roller movable between a separating position wherein the roller is separated from the facing member and a contacting position wherein the roller contacts the recording medium on the facing member;

an urging member applying a first urging force to the roller in a second direction to separate the roller from the recording medium; and a drive force applying member applying a second urging force to the holding member via a clutch member to urge the roller toward the recording medium in a third direction opposite to the second direction and applying a rotational force via the clutch member to the roller to rotate the roller about the rotation shaft, wherein the clutch member connects the drive force applying member with the holding member from a disconnected state at least once during movement of the roller from the contacting position to the separating position to exert the second urging force, countering the first urging force, to the holding member at least once during movement of the roller from the contacting position to the separating position.

2. The roller unit according to claim 1, wherein the second urging force is also provided to the roller via the holding member during movement of the roller from the separating position to the contacting position.

3. The roller unit according to claim 1, wherein the drive force applying member rotates the roller about the rotation shaft thereof after the roller begins to move from the separating position to the contacting position or after the roller contacts the recording medium on the facing member.

4. The roller unit according to claim 1, wherein a total time that the second urging force does not apply to the roller is longer than a total time that the second urging force applies to the roller during movement of the roller from the contacting position to the separating position.

5. The roller unit according to claim 1, wherein the first direction is perpendicular to each of the second and third directions.

6. The roller unit according to claim 1, wherein the holding member moves pivotally between the separating position and the contacting position.

7. The roller unit according to claim 2, wherein the second urging force is larger than the first urging force in the contacting position of the roller.

8. The roller unit according to claim 1, wherein the clutch member once connects the drive force applying member with the holding member from the disconnected state during the movement of the roller from the contacting position to the separating position and returns to the disconnected state prior to the roller reaching the separating position.

9. The roller unit according to claim 1, wherein the clutch member intermittently connects and disconnects the drive force applying member with the holding member during the movement of the roller from the contacting position to the separating position.

10. An image forming apparatus comprising:

an image forming unit, having the roller unit of claim 1.

11. The image forming apparatus according to claim 10, wherein the roller unit is a mechanism for feeding the recording medium.

12. The image forming apparatus according to claim 10, wherein the roller unit is a mechanism for fixing toner images on the recording medium.

* * * * *